US010738542B2

(12) United States Patent
Adam et al.

(10) Patent No.: US 10,738,542 B2
(45) Date of Patent: Aug. 11, 2020

(54) ACTUATING FORCE CONTROL FOR DOWNHOLE TOOLS

(71) Applicant: Baker Hughes, a GE company, LLC, Houston, TX (US)

(72) Inventors: Mark K. Adam, Houston, TX (US); Mahmoud M. Marzouk, Rosharon, TX (US); Christopher R. Hern, Porter, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 302 days.

(21) Appl. No.: 15/791,881

(22) Filed: Oct. 24, 2017

(65) Prior Publication Data

US 2019/0119991 A1 Apr. 25, 2019

(51) Int. Cl.
*E21B 17/06* (2006.01)

(52) U.S. Cl.
CPC ..... *E21B 17/06* (2013.01)

(58) Field of Classification Search
CPC ..... E21B 17/06
See application file for complete search history.

(56) References Cited

U.S. PATENT DOCUMENTS 2,500,276 A * 3/1950 Church ..... E21B 17/06 285/2
3,190,377 A * 6/1965 Rassieur ..... E21B 49/02 175/257
4,821,818 A * 4/1989 Mefferd ..... E21B 17/046 175/323
9,175,533 B2 * 11/2015 Standridge ..... E21B 33/134
10,246,966 B2 * 4/2019 Melenyzer ..... E21B 33/1204
2007/0089912 A1 * 4/2007 Eddison ..... E21B 10/32 175/269
2009/0205840 A1 * 8/2009 O'Connor ..... E21B 23/00 166/382
2010/0232887 A1 * 9/2010 Parsons ..... E02D 5/385 405/237
2011/0147014 A1 * 6/2011 Chen ..... E21B 23/04 166/387
2013/0032326 A1 * 2/2013 Lea-Wilson ..... E21B 17/06 166/55
2013/0048311 A1 * 2/2013 Slup ..... E21B 23/01 166/382

(Continued)

FOREIGN PATENT DOCUMENTS

CN 104033118 A 9/2014
JP 200677388 * 3/2006

(Continued)

OTHER PUBLICATIONS

PCT Application No. PCT/US2018/054396—International Search Report dated Feb. 1, 2019.

*Primary Examiner* — Michael A Riegelman
(74) *Attorney, Agent, or Firm* — Mossman Kumar & Tyler PC

(57) ABSTRACT

An apparatus for temporarily connecting a first tool part to a second tool part of a tool includes a plurality of frangible members connecting the first tool part to the second tool part. The frangible members break only after being subjected to a predetermined applied force. The frangible members cooperate to differentially resist loading applied to the tool.

21 Claims, 7 Drawing Sheets

(56) References Cited

U.S. PATENT DOCUMENTS

| | | | | |
|---|---|---|---|---|
| 2014/0251631 | A1* | 9/2014 | Curtiss, III | E21B 43/0122 166/338 |
| 2014/0338892 | A1* | 11/2014 | Meador | E21B 43/10 166/216 |
| 2014/0352975 | A1* | 12/2014 | Rogers | E21B 43/10 166/377 |
| 2016/0281442 | A1* | 9/2016 | Stokes | E21B 23/00 |
| 2017/0138139 | A1* | 5/2017 | Hern | E21B 17/042 |
| 2017/0314339 | A1* | 11/2017 | Lee | E21B 17/046 |
| 2018/0016862 | A1* | 1/2018 | Meeks | E21B 29/00 |
| 2018/0258724 | A1* | 9/2018 | Massey | E21B 31/1075 |
| 2018/0298707 | A1* | 10/2018 | Adam | E21B 23/004 |
| 2018/0298723 | A1* | 10/2018 | Randle | E21B 17/006 |
| 2019/0119991 | A1* | 4/2019 | Adam | E21B 17/06 |

FOREIGN PATENT DOCUMENTS

| | | | |
|---|---|---|---|
| WO | 2010105258 | A1 | 9/2010 |
| WO | 2014149146 | A1 | 9/2014 |

* cited by examiner

ACTUATING FORCE CONTROL FOR DOWNHOLE TOOLS

BACKGROUND OF THE DISCLOSURE

1. Field of the Disclosure

The disclosure relates generally to systems and methods for actuating downhole tools.

2. Description of the Related Art

Hydrocarbons such as oil and gas are recovered from a subterranean formation using a borehole drilled into the formation. During all phases of well construction and production, a variety of downhole tools are deployed into the borehole to perform any number of tasks. Some tools have components that are temporarily coupled or connected to one another. By temporarily, it is meant that at some point, the components are to be separated from one another. Because a mechanical assembly is often used to connect such components, a mechanical force (e.g., compression, tension or torsion) is used as an actuation force to separate the components. Traditionally, the mechanical assembly must be strong enough to resist the various forces that are applied to the downhole tool while the downhole tool is conveyed to a target location in the borehole. As a consequence, the actuation force is conventionally required to be at least as great as the forces encountered during initial tool deployment.

This disclosure provides, in part, actuation devices and methods that do not have these and other drawbacks of the prior art in the oil and gas field as well as other applications.

SUMMARY OF THE DISCLOSURE

In aspects, the present disclosure provides an apparatus for temporarily connecting a first tool part to a second tool part of a tool. The apparatus may include a plurality of frangible members connecting the first tool part to the second tool part. The frangible members may be configured to break only after being subjected to a predetermined applied force. The frangible members cooperate to differentially resist loading applied to the tool.

In aspects, the present disclosure also provides a downhole tool having a first tool part and a second tool part. The first tool part has a plurality of slots formed thereon, wherein a dimension of at least two slots is different. The second tool part has a plurality of frangible members configured to break only after being subjected to a predetermined actuation force, wherein at least one frangible member of the plurality of frangible members is received in one slot of the plurality of slots.

In further aspects, the present disclosure provides a method for temporarily connecting a first tool part to a second tool part of a tool. The method may include connecting the first tool part to the second tool part by using a plurality of frangible members. The frangible members may be configured to break only after being subjected to a predetermined applied force. The frangible members cooperate to differentially resist loading applied to the tool.

It should be understood that examples of certain features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein:

FIG. 9 is a schematic view of an embodiment of an actuation assembly in accordance with the present disclosure that utilizes a plurality of frangible elements and an associated slot that differentially resist axial and/or torsional loading; and.

DETAILED DESCRIPTION OF THE DISCLOSURE

The present disclosure relates to devices and methods for providing differential resistance for tools. In one non-limiting use, such tools may be actuators for downhole tools.

Such actuation may be needed during any stage of well construction or production (e.g., drilling, logging, completion, workover, remediation, etc.). The term "actuate" or "actuation" refers to action that changes a status, condition, position, and/or orientation of a tool. Embodiments of the present disclosure differentially control the torsional and/or axial force resistance capacities of a downhole tool. Illustrative non-limiting embodiments are discussed below.

Figure 1:
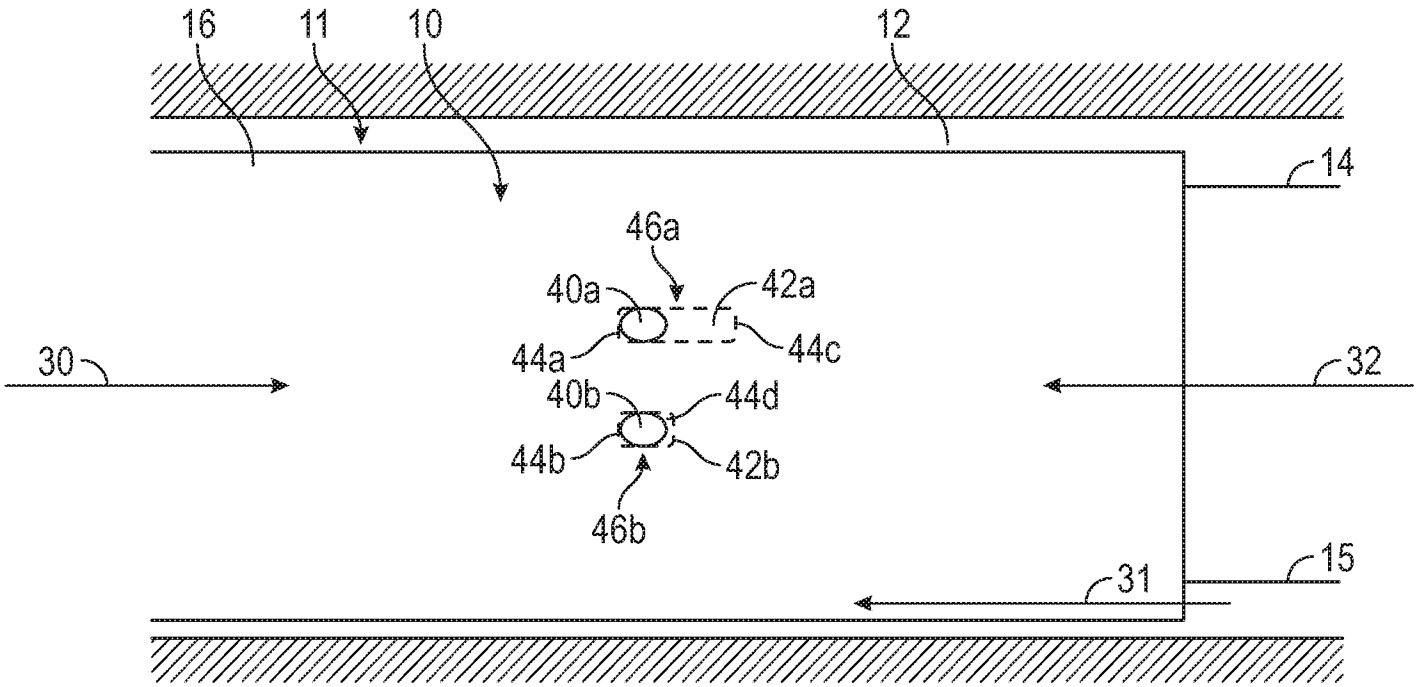
FIG. 1 is a schematic side view of an actuation assembly in accordance with one embodiment of the present disclosure that includes frangible elements and associated slots that differentially resist axial loading while non-differentially resisting torsional loading.
Figure 2:
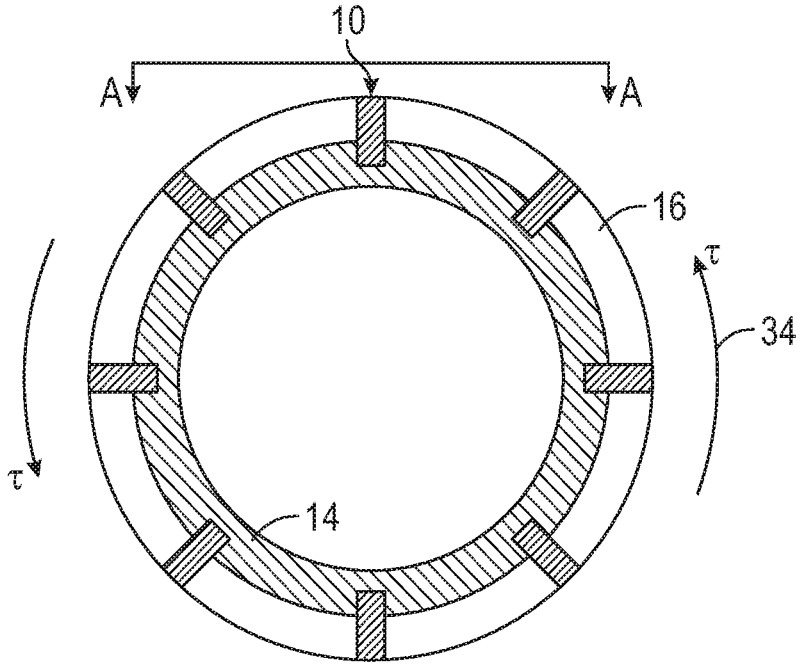
FIG. 2 is a schematic end view of an actuation assembly in accordance with one embodiment of the present disclosure.

Referring now to FIGS. 1 and 2, there is shown one embodiment of an actuation assembly 10 for actuating a downhole tool 11. The actuation assembly 10 may be conveyed along a borehole 12 via a suitable conveyance device, such as drill pipe or coiled tubing (not shown). In one embodiment, the actuation assembly 10 may be used to temporarily connect two discrete parts of the downhole tool 11, such an inner mandrel 14 and an outer tool assembly 16. As further discussed below, the connection is differential because the amount of resistance to an applied axial force varies with the direction or orientation of such a force; e.g., a greater/less resistance to an axial force is provided if that force is applied in an uphole direction as opposed to a downhole direction or greater/less resistance is provided if a torsional force is applied in a clockwise direction as opposed to a counter-clockwise direction. In FIG. 1, the actuation assembly 10 provides differential resistance to axial loadings and non-differential resistance to torsional loadings as described in detail below.

In one non-limiting embodiment, the actuation assembly 10 includes a plurality of frangible elements 40*a,b* disposed in the outer tool assembly 16 and associated slots 42*a,b* formed in the inner mandrel 14. As used herein, a "frangible element" is an element that is specifically constructed to fracture, crack, or otherwise lose structural integrity (or generally "break") once a predetermined force level is encountered. Thus, the breaking is an intended and desired function of a frangible element. The predetermined force may be an actuation force, such an axial force applied by putting the conveyance device, such as a drill string or coiled tubing in tension or compression. The actuation force may also be torsional. As used herein a loading "mode," refers to the type of loading, namely, tension, compression, torsion.

The slots 42*a,b* are each defined by lateral surfaces and parallel surfaces. By "lateral," it is meant transverse or perpendicular to the direction of movement of the inner mandrel 14 and/or the outer assembly 16 during actuation. By "parallel," it is meant aligned with the direction of movement of the inner mandrel 14 and/or the outer assembly 16 during actuation. The parallel surfaces 46*a,b* of slots 42*a,b* have similar dimensions; i.e., they have the same width. However, the slot 42*a* is elongated relative to slot 42*b*. Thus, the distance separating lateral surfaces 44*a,c* of slot 42*a* is greater than the distance separating the lateral surfaces 44*b,d* of slots 42*b*. For tubular components, the surfaces 46*a,b* may be considered axially aligned surfaces and the lateral surfaces 44*a,b* may be considered circumferentially aligned surfaces.

The frangible elements 40*a,b* are positioned to simultaneously contact a first set of lateral surfaces and sequentially contact a second set of lateral surfaces. Specifically, the frangible elements 40*a,b* contact the uphole lateral surfaces 44*a,b*, respectively, at the same time. Thus, the axial loading on the downhole tool 11 is distributed among both of the frangible elements 40*a,b*. In contrast, the frangible elements 40*a,b* contact the downhole lateral surfaces 44*c,d*, respectively, at different times. Thus, all of the axial loading on the downhole tool 11 is borne by one of the frangible elements 40*a,b* at any given time. As will be apparent below, this arrangement provides a differential, or asymmetric, resistance to loading that reduces the actuation force needed to actuate the downhole tool 11.

Figure 1A:
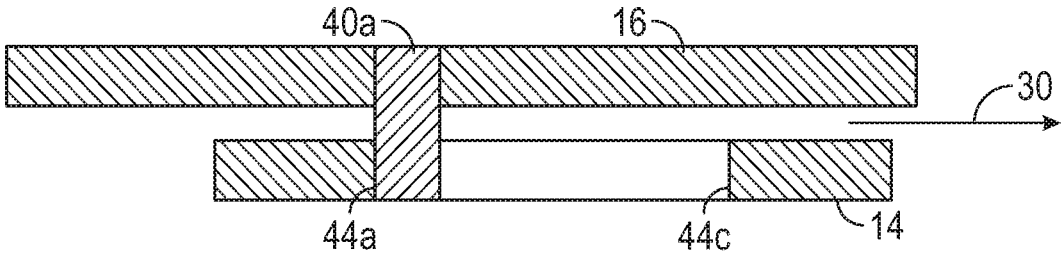
FIG. 1A is a sectional view of a frangible element co-acting with an outer tool assembly and the mandrel.

While conveying the downhole tool 11 into the borehole 12, which is the downhole direction 30, both frangible elements 40*a,b* physically contact the mandrel 14 at the lateral surfaces 44*a,b*, respectively. This is due to the presence of a drag force 31 acting in the uphole direction 32, which resists the downhole movement of the outer tool assembly 16. As best seen in FIG. 1A, to overcome the drag force on the outer tool assembly 16, the mandrel 14 has to effectively pull the outer tool assembly 16 using the frangible elements 44*a,b*. Thus, both frangible elements 40*a,b*, which are fixed to the outer tool assembly 16, bear the axial loading applied to the downhole tool 11 and thereby cooperate to provide resistance to the drag force 31. As used herein, "cooperate" means a sharing or dividing of the applied loading.

Actuation occurs by first fixing the inner mandrel 14 a surface in the borehole, and then placing the tool assembly 16 into compression, which moves the tool assembly 16 in the downhole direction 30. Initially, only the frangible element 40*b* physically contacts and resists loading caused by the tool assembly 16, which occurs at the lateral surface 44*d*. The frangible element 40*a* does not provide any meaningful resistance because it does not contact the lateral surface 44*c* as shown in FIG. 1A. Once the applied actuation force is reached, the frangible element 40*b* breaks and the tool assembly 16 moves in the downhole direction 30 until the frangible element 40*a* contacts the lateral surface 44*c*. The applied actuation force then breaks the frangible element 40*a* and the mandrel 14 is released from the tool assembly 16.

It should be appreciated that the actuation force is only a fraction of resistance force present while conveying a downhole tool. That is, for actuation of the illustrated embodiment, the sequential breaking of the frangible elements 40*a,b* reduces the available resistance to applied loading resulting from axial loading in the downhole direction 30. The use of more frangible elements 40,*b* would further reduce the fraction of force needed to disconnect the tool assembly 16 and the mandrel 14. Thus, the actuation assembly 14 advantageously has a locking strength sufficient to withstand the drag forces encountered by a downhole tool being conveyed into a borehole, but reduces the load resistance when it is desired to release the tool assembly 16 from the mandrel 14. It should be noted that while the resistance to axial loading is differential, the resistance to torsional loading is non-differential. That is, the frangible elements 40*a,b* have the same resistance to torsional loading regardless of direction. Thus, the differential resistance depends on the mode of loading.

It should be understood that the actuation assembly 10 is susceptible to numerous variants. For instance, while the mandrel 14 is shown disposed inside the tool assembly 16, it should be understood that two parts need only overlap sufficiently to interpose the actuation assembly 10. Also, the illustrated embodiment has frangible elements 40*a,b* fixed to the outer tool assembly 16 and the openings 42*a,b* formed in a section or body 15 associated with the inner mandrel 14. However, a reverse arrangement may also be used; i.e., the frangible elements 40*a,b* may be fixed to the inner mandrel 14 and the openings 42*a,b* are formed in outer tool assembly 16. Additionally, while two frangible elements and associated openings are shown, other embodiments may include three or more axially and/or circumferentially distributed frangible elements and associated openings. Still other variants are discussed below.

Figure 3:
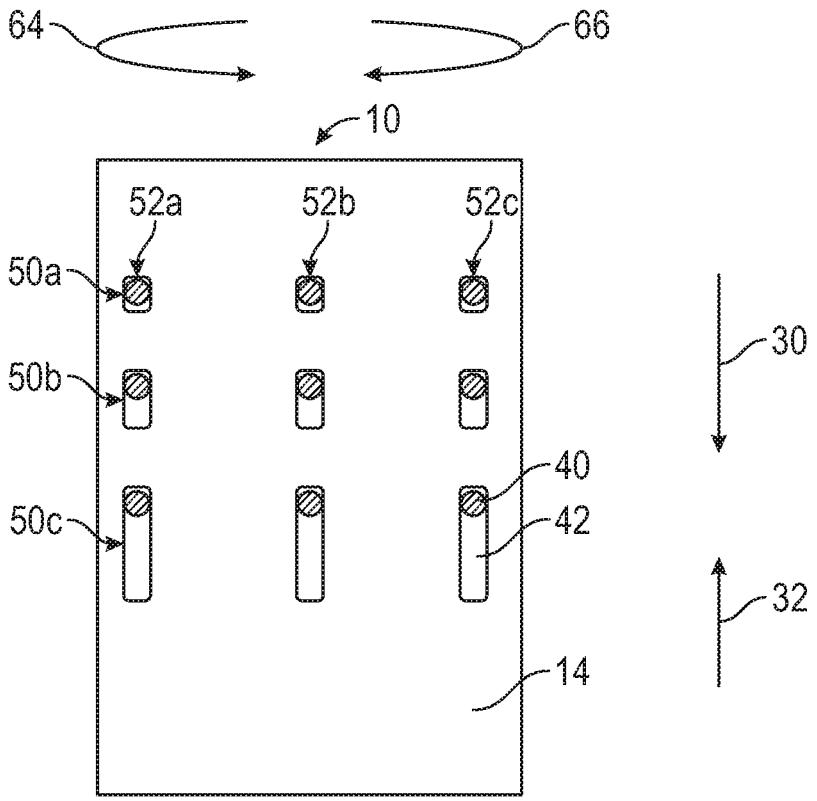
FIG. 3 is a schematic side view of an actuation assembly in accordance with one embodiment of the present disclosure that includes multiple rows and columns of frangible elements and associated slots arranged to differentially resist axial loadings while non-differentially resisting torsional loadings.

Referring to FIG. 3, the actuation assembly 10 includes a plurality of frangible elements 40 and associated slots 42 arranged in rows 50*a,b,c* and columns 52*a,b,c*. In each row 50*a,b,c*, the frangible elements 40 and associated slots 42 are arranged to provide cooperative resistance to applied force. In each column 52*a,b,c*, the frangible elements 40 and associated slots 42 are arranged to sequentially break the frangible elements 40. While being conveyed downhole in the direction 30, all of the frangible elements 40 resist the load applied by drag forces 31 (FIG. 1), which is in direction 32. During actuation, the compression on the outer tool assembly 16 (FIG. 1) applies a force in the direction 30 to the frangible elements 40. frangible elements in row 50*a* must break before the frangible elements in row 50*b* take up the applied loading. Similarly, the frangible elements in row 50*b* must break before the frangible elements in row 50*c* take up the applied loading. Thus, the resistance to axial load is differential because only a fraction of frangible elements 40 resist loading when it is applied in direction 30. It should be noted that while the resistance to axial loading is differential, the resistance to torsional loading is non-differential. Because the width of the slots 42 are the same, the frangible elements 40 have the same resistance to torsional loading regardless of the rotational direction 64, 44 in which the torsional loading is applied.

Figure 4:
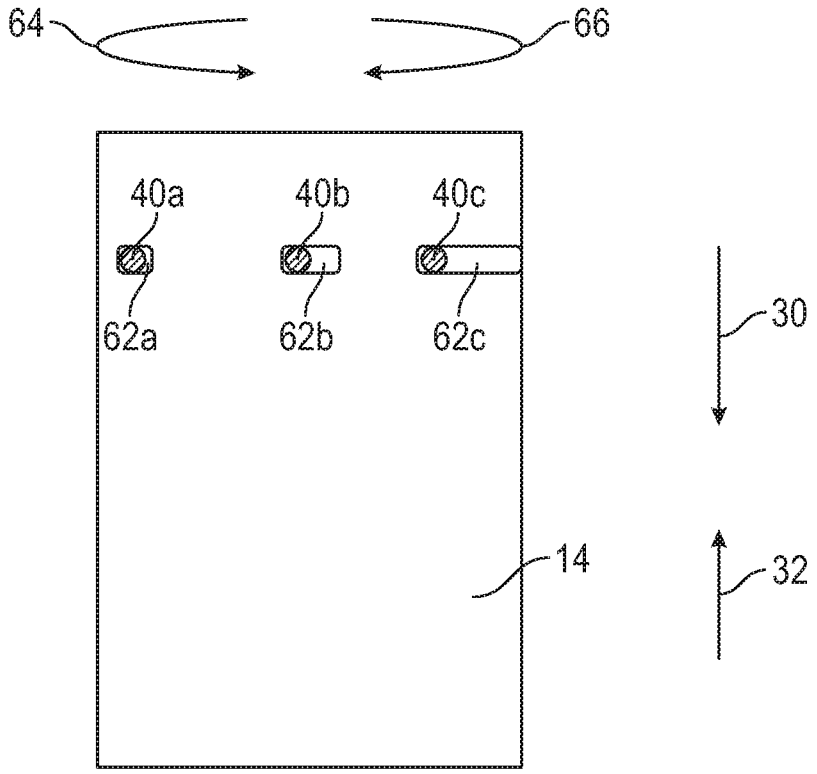
FIG. 4 is a schematic side view of an actuation assembly in accordance with one embodiment of the present disclosure that includes frangible elements and associated slots that differentially resist torsional loading while non-differentially resisting axial loadings.

Referring to FIG. 4, the actuation assembly 10 includes a plurality of frangible elements 40*a,b,c* and associated slots 62*a,b,c* arranged to differentially resist torsional loading. In this arrangement, the slots 62*a,b,c* are elongated circumferentially as opposed to the axially elongated slots 42*a,b*, of FIG. 1. When the tool assembly 16 (FIG. 1) and connected frangible elements 40*a,b,c* are rotated in the second direction 66, all of the frangible elements 40*a,b,c* cooperatively resist the applied torsional loading because all the frangible elements 40*a,b,c* abut a surface that is lateral to and blocks the direction of motion. Actuation occurs when the tool assembly 16 (FIG. 1) is rotated in a first direction 64 opposite to the second direction 66. During this rotation, the actuation force sequentially breaks the frangible elements 40*a,b,c* because of the staggered contact with blocking lateral surfaces. It should be noted that while the resistance to torsional loading is differential, the resistance to axial loading is non-differential. Because the axial length of the slots 62*a,b,c*, are the same, the frangible elements 40 have the same resistance to axial loading regardless of direction of the axial loading. Because the width of the slots 62*a,b,c* are the same, the frangible elements 40*a,b,c* have the same resistance to axial loading regardless of the axial directions 30, 32 in which the axial loading is applied.

Figure 5:
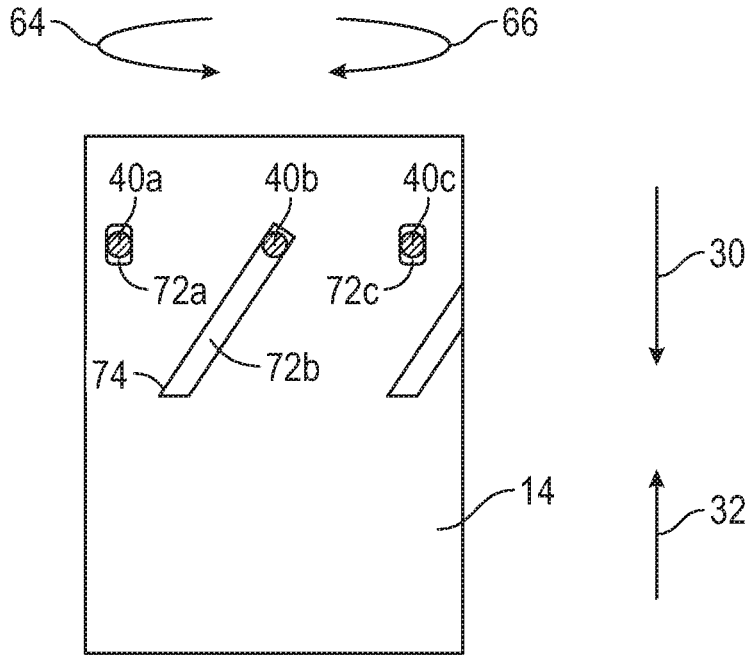
FIG. 5 is a schematic side view of an actuation assembly in accordance with one embodiment of the present disclosure that includes frangible elements and associated slots that differentially resist axial and torsional loadings in two discrete stages.

Referring to FIG. 5, the actuation assembly 10 includes a plurality of frangible elements 40*a,b,c* and associated slots 72*a,b,c* arranged to resist torsional loading. In this arrangement, at least one of the slots 72*a,b,c* is elongated in a helical direction. When the tool assembly 16 (FIG. 1) is rotated in the second direction 66, all of the frangible elements 40*a,b,c* resist the applied torsional loading. When the tool assembly 16 (FIG. 1) is rotated in a first direction 64 opposite to the first direction 66, the frangible elements 40*a,c* resist the applied torsional loading and break at the same time. However, frangible element 40*b* slides along the slot 72*b* and resists loading after reaching a terminal end 74 of the slot 72*b*. Thus, the tool assembly 16 (FIG. 1) may move axially a predetermined distance before being completely released from the mandrel 14.

Similarly, when the tool assembly 16 (FIG. 1) is axially loaded in the first direction 30 by drag force 31 (FIG. 1), all of the frangible elements 40*a,b,c* resist the applied axial loading. When the tool assembly 16 (FIG. 1) is loaded in the second direction 32 opposite to the first direction 30, the frangible elements 40*a,c* resist the applied axial loading and break at the same time. However, frangible element 40*b* slides along the slot 72*b* and resists loading after reaching a terminal end 74 of the slot 72*b*. Thus, the tool assembly 16 (FIG. 1) may move axially a predetermined distance before being completely released from the mandrel 14.

Figure 6:
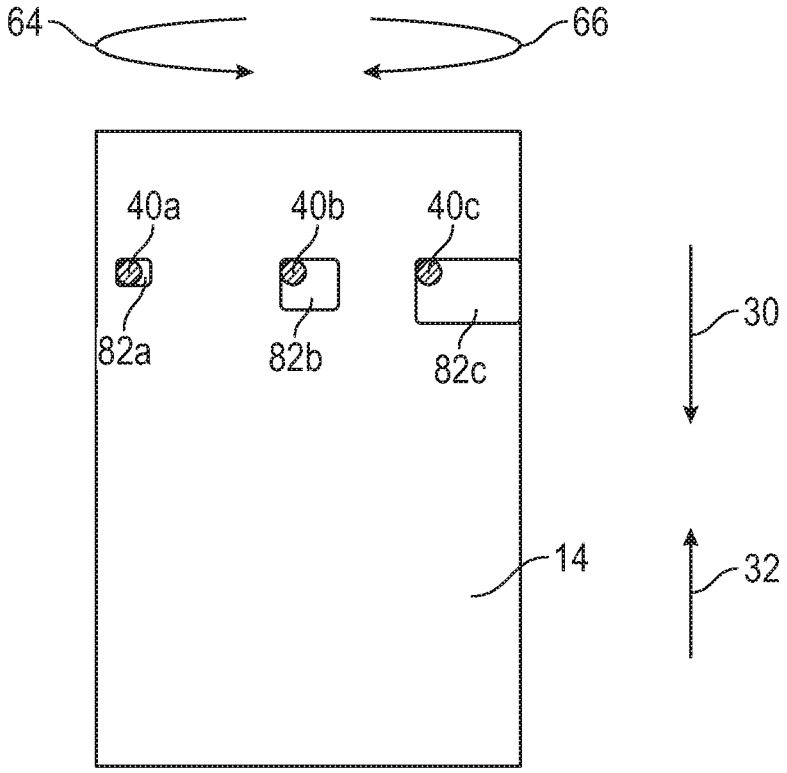
FIG. 6 is a schematic side view of an actuation assembly in accordance with one embodiment of the present disclosure that includes frangible elements and associated slots that differentially resist axial and torsional loading.

Referring to FIG. 6, the actuation assembly 10 includes a plurality of frangible elements 40*a,b,c* and associated slots 82*a,b,c* arranged to differentially resist both torsional and axial loading. In this arrangement, the slots 82*b,c* are elongated axially and circumferentially relative to the slot 82*a*.

Thus, while moving in the downhole direction 30, all frangible elements 40*a,b,c* physically contact the mandrel 14 and provide resistance to applied axial loadings as previously discussed. However, when moving in uphole direction 32, the frangible elements 40*a,b,c* break sequentially as discussed in connection with FIG. 1. Similarly, when the tool assembly 16 (FIG. 1) is rotated in the second direction 66, all of the frangible elements 40*a,b,c* resist the applied torsional loading. When the tool assembly 16 is rotated in the first direction 64, the frangible elements 40*a,b,c* break sequentially as described in connection with FIG. 4.

Figure 7:
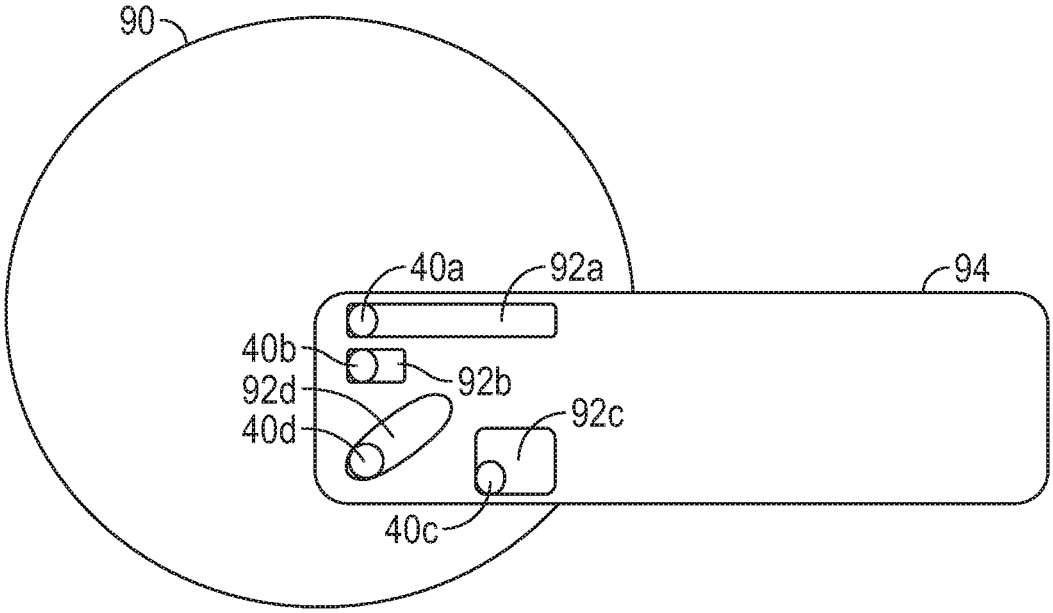
FIG. 7 is a schematic view of an actuation assembly in accordance with one embodiment of the present disclosure that includes non-tubular members, frangible elements, and associated variegated slots that differentially resist axial and torsional loading.

Referring to FIG. 7, there is illustrated still another arrangement in accordance with the present disclosure that illustrates the application of the present teachings to non-tubular components. In FIG. 7, a plurality of frangible elements 40*a,b,c,d* are fixed to a first platen member 90 and a plurality of associated slots 92 formed in a second platen member 94. It should be noted that the slots 92*a,b,c,d* doe not all share a common shape. Slots 92*a,b* are rectangular with different lengths. Slot 99*c* is square. Slot 99*d* is oval and directs the frangible element 40*d* along a direction that is angled relative to the slots 92*a,b*. The platen members 90, 92 may have any geometrical shape, included, but not limited to, circular, rectangular, square, oval, hexagonal, etc. Further, the platen members 90, 92 may rotate and/or translate in one or more dimensions. For example, platen member 90 may spin about a central axis and/or platen member 92 may slide along one or more different axes. Thus, the present teachings are not limited to any particular shapes or types of motion.

Figure 8:
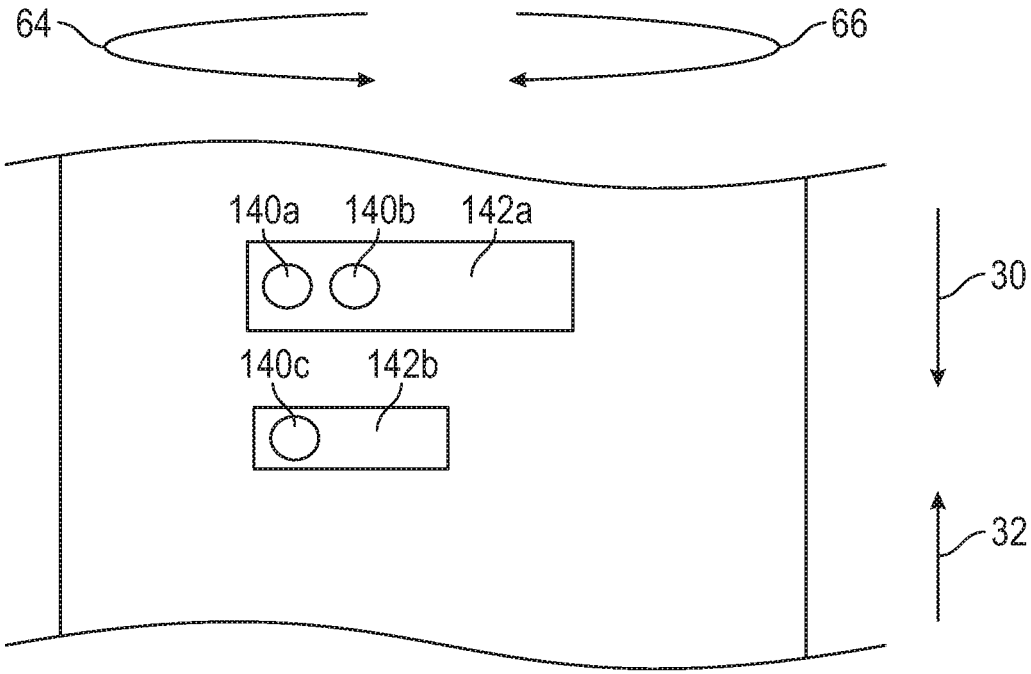
FIG. 8 is a schematic view of an actuation assembly that utilize various arrangements in with the present disclosure that includes frangible elements and associated variegated slots that differentially resist axial and/or torsional loading.
Figure 9:
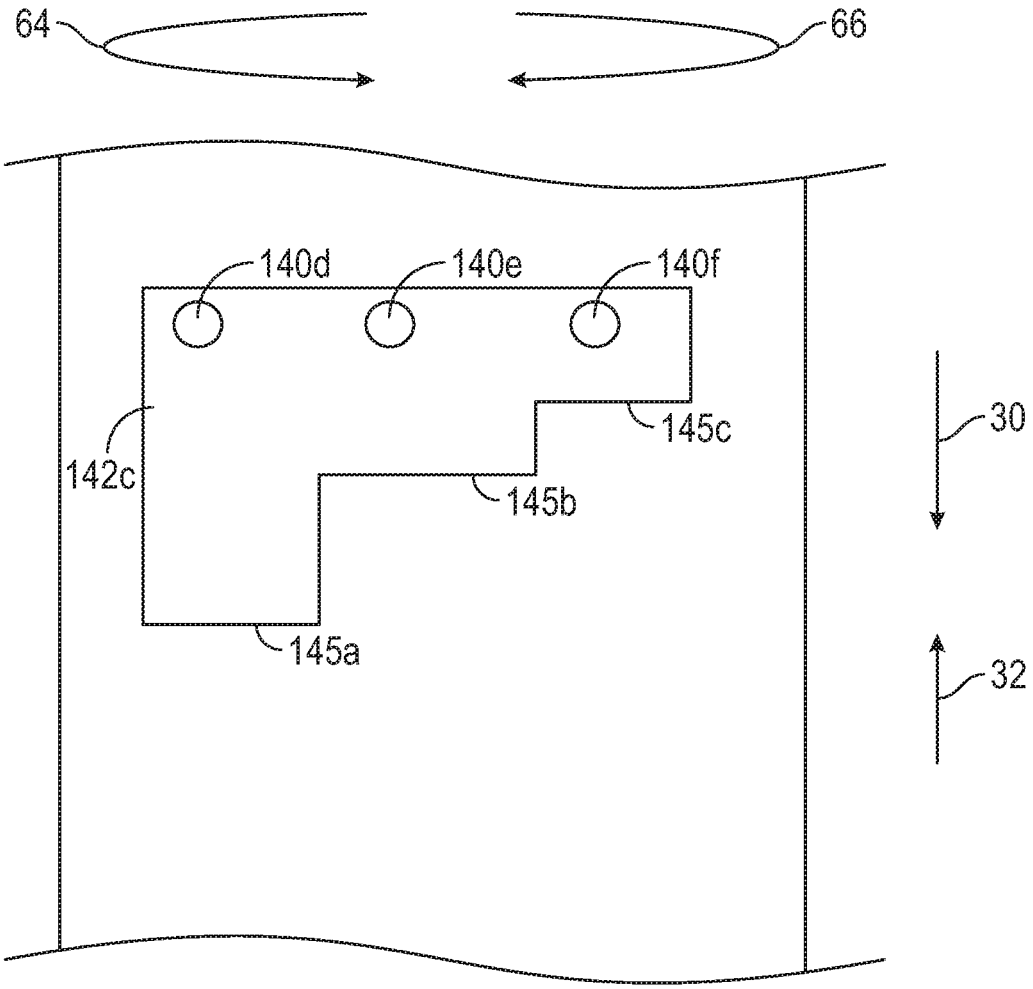

Referring to FIGS. 8-9, there are illustrated other arrangements in accordance with the present disclosure that illustrate the present teachings.

Referring to FIG. 8, frangible elements 140*a,b,c* are used in a differential resistance arrangement wherein one of the slots includes multiple frangible elements. Slot 142*a* has two frangible elements 140*a,b*. Slot 142*b* has one frangible element 140*c*. Slots 142*a* and 142*b* have the same width, but different lengths. Thus, the FIG. 8 arrangement provides a non-differential resistance to axial loadings 30, 32. The resistance to torsional loading is differential. Specifically, two frangible elements 140*a,c* simultaneously resist torsional loading in the first direction 64. In the opposite direction 66 of torsional loading, the smaller length of slot 142*b* causes frangible element 140*c* to be sheared first. Thereafter, frangible elements 140*a,b* are sequentially sheared. Thus, only one frangible element resists loading in the second direction 66. The arrangement may also be re-oriented by ninety degrees to provide differential resistance to axial loading. Of course, any intermediate angles and other variations described above may also be used.

Referring to FIG. 9, there is an arrangement in accordance with the present disclosure that uses multiple frangible elements 140*d,e,f* circumferentially, or laterally, distributed in one slot 149*c*. The slot 149*c* includes staggered edges 145*a,b,c*. The FIG. 9 arrangement provides differential resistance to axial loadings 30, 32 and non-differential resistance to torsional loadings 64, 66. Specifically, all three frangible elements 140*d,e,f* simultaneously resist axial loading 30. During the opposite direction axial loading 32, the frangible elements 140*d,e,f* are sequentially sheared by the staggered edges 145*a,b,c*. That is, frangible element 140*f* is first sheared by edge 145*c*, thereafter frangible elements 140*e* and 140*d* are sheared by edges 145*b* and 145*a*, respectively. The arrangement may also be re-oriented by ninety degrees to provide differential resistance to torsional loading. Of course, any intermediate angles and other variations described above may also be used.

FIGS. 10A-F illustrate embodiments of actuation assemblies that may utilize the differential loading arrangements (e.g., different slot sizes and configurations) as discussed above to provide different resistance to loadings depending on the direction of the loading within the same loading mode (e.g., axial or torsional). The embodiments of FIGS. 10A-F illustrate how the previously described actuation assemblies may also be configured to provide differential resistance to loading depending on the mode of the loading; e.g., greater resistance to torsional loading than axial loading, or vice versa.

Figure 10A:
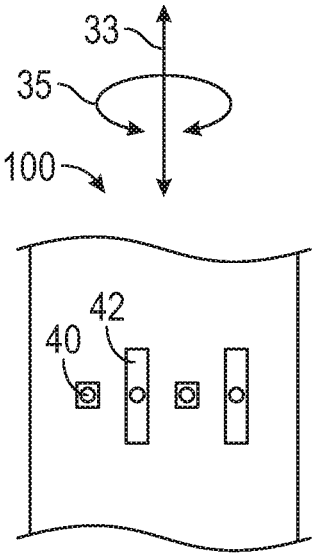
FIGS. 10A-F are schematic views of embodiments actuation assemblies having differential load between the different load modes.

Referring to FIG. 10A, there is shown an embodiment of an actuation assembly 100 wherein a resistance to axial loading 33 is a fraction of the resistance to torsional loading 35. Specifically, all of the frangible elements 40 simultaneously resist torsional loading 35 irrespective of direction because the widths of the slots 42 are the same. However, only a fraction of the frangible elements 40 simultaneously resist axial loading 33, depending on direction, because the axial lengths of the slots 42 are different.

Figure 10B:
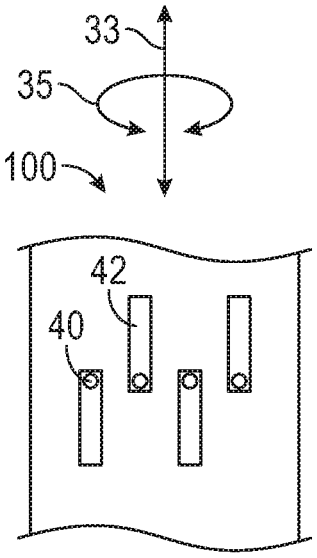

Referring to FIG. 10B, there is shown another embodiment of an actuation assembly 100 wherein a resistance to axial loading 33 is a fraction of the resistance to torsional loading 35. Specifically, all of the frangible elements 40 simultaneously resist torsional loading 35 irrespective of direction because the widths of the slots 42 are the same. However, only a fraction of the frangible elements 40 simultaneously resist axial loading 33, depending on direction, because the lateral edges of the slots 42 are staggered to prevent simultaneously contact with their respective frangible elements 40.

Figure 10C:
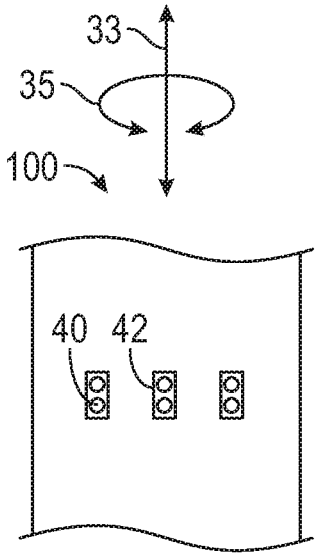

Referring to FIG. 10C, there is shown an embodiment of an actuation assembly 100 wherein a resistance to axial loading 33 is a fraction of the resistance to torsional loading 35. Specifically, all of the frangible elements 40 simultaneously resist torsional loading 35 irrespective of direction whereas only a fraction of the frangible elements 40 simultaneously resist axial loading 33.

Figure 10D:
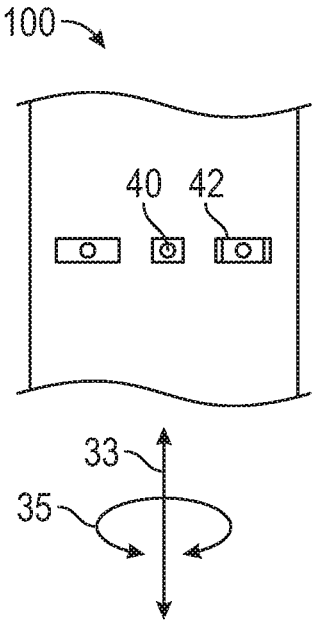

Referring to FIG. 10D, there is shown an embodiment of an actuation assembly 100 wherein a resistance to torsional loading 35 is a fraction of the resistance to axial loading 33. Specifically, all of the frangible elements 40 simultaneously resist axial loading 33 irrespective of direction because the axial lengths of the slots 42 are the same. However, only a fraction of the frangible elements 40 simultaneously resist axial loading 33, depending on direction, because the widths of the slots 42 are different.

Figure 10E:
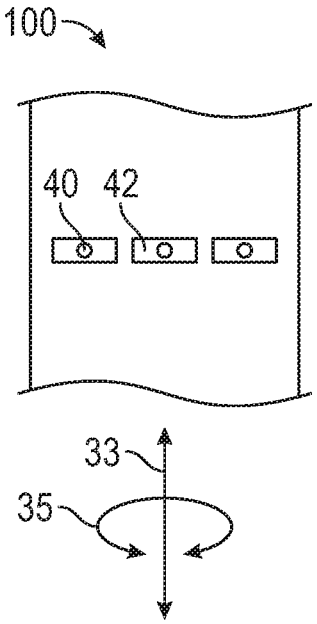

Referring to FIG. 10E, there is shown another embodiment of an actuation assembly 100 wherein a resistance to torsional loading 35 is a fraction of the resistance to axial loading 33. Specifically, all of the frangible elements 40 simultaneously resist axial loading 33 irrespective of direction because the axial lengths of the slots 42 are the same. However, only a fraction of the frangible elements 40 simultaneously resist torsional loading 35, depending on direction, because the frangible elements 40 have staggered positions in their respective slots 42 to prevent simultaneously contact.

Figure 10F:
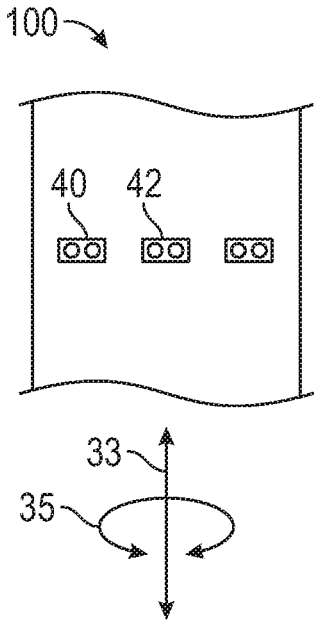

Referring to FIG. 10F, there is shown an embodiment of an actuation assembly 100 wherein a resistance to torsional loading 35 is a fraction of the resistance to axial loading 33. Specifically, all of the frangible elements 40 simultaneously resist axial loading 33 irrespective of direction whereas only a fraction of the frangible elements 40 simultaneously resist torsional loading 35.

Referring to FIG. 1, the downhole tool 11 may be any tool configured for use in a borehole 12. By way of illustration, and not limitation, the downhole tool 11 may be a drilling assembly, a reamer, a steering assembly, a downhole motor, formation evaluation tool, a thruster, liner assembly, a completion tool, a cementing tool, a well packer, a bridge plug, an inflow control device, a perforating tool, etc.

From the above, it should be appreciated that what has been described includes, in part, a downhole tool that may include at least two discrete components, such as a mandrel disposed within an assembly, and an actuation assembly that maintains the mandrel and the assembly in specified axial and rotational relationships prior to tool actuation. The actuation assembly maintains these relationships stronger in one or more loading scenarios versus others. In embodiments, the actuation assembly includes frangible elements and openings that are combined using varying dimensions such as length and width and/or orientations to allow dissimilar loading conditions in different load cases.

The present disclosure is susceptible to embodiments of different forms. For instance, while the present disclosure is discussed in the context of a hydrocarbon producing well, it should be understood that the present disclosure may be used in any borehole environment (e.g., a geothermal well). Moreover, the present teachings may be used for actuators and other tools in any industry; e.g., automotive, aerospace, construction, etc. There are shown in the drawings, and herein will be described in detail, specific embodiments of the present disclosure with the understanding that the present disclosure is to be considered an exemplification of the principles of the disclosure and is not intended to limit the disclosure to that illustrated and described herein.

What is claimed is:

1. An apparatus for temporarily connecting a first tool part to a second tool part of a tool, the apparatus comprising:

a plurality of frangible members connecting the first tool part to the second tool part, the frangible members being configured to break only after being subjected to a predetermined applied force, the frangible members cooperating to differentially resist loading applied to the tool, wherein the frangible members are fixed in the first tool part; and a body associated with the second tool part, wherein the body includes a plurality of slots formed thereon, wherein at least one frangible member of the plurality of frangible members is received in one slot of the plurality of slots.

2. The apparatus of claim 1, wherein the loading comprises a first load having a first mode and a second load having a second mode, wherein the second mode is different from the first mode, the frangible members cooperating to differentially resist the first load and non-differentially resist the second load.

3. The apparatus of claim 1, wherein the loading comprises a first load having a first mode and a second load having a second mode, wherein the second mode is different from the first mode, the frangible members cooperating to differentially resist the first load and the second load.

4. The apparatus of claim 1, wherein the loading has a mode selected from one of: (i) a compression, (ii) tension, and (iii) torsional.

5. The apparatus of claim 1, wherein the loading comprises a first load in a first direction and a second load in a second direction different from the first direction, wherein the plurality of frangible members cooperate to resist the first load at the same time and sequentially break when subjected to the second load.

6. The apparatus of claim 1, wherein the loading has a plurality of different modes, the frangible members cooperating to differentially resist the loading based on the mode of the loading.

7. The apparatus of claim 6, wherein the plurality of mode includes at least one of: (i) an axial loading, and (ii) a torsional loading.

8. The apparatus of claim 1, wherein a first set of the plurality of frangible members resist a loading applied in a first direction and a second set of the plurality of frangible members resist a loading in a second direction that is different from the first direction, and wherein the second set of frangible members has a different number of frangible members than the first set of frangible members.

9. The apparatus of claim 8, wherein the applied loadings in the first and the second direction are one of: (i) an axially applied loading, and (ii) a torsional loading.

10. A downhole tool, comprising:

a first tool part having a plurality of slots formed thereon, wherein a dimension of at least two slots is different; and a second tool part having a plurality of frangible members configured to break only after being subjected to a predetermined actuation force, wherein at least one frangible member of the plurality of frangible members is received in one slot of the plurality of slots.

11. The downhole tool of claim 10, wherein the dimension is one of: (i) aligned with a circumference of the first tool part, (ii) parallel with an axis of the first tool part, and (iii) transverse to the axis of the first tool part.

12. The downhole tool of claim 10, wherein the plurality of frangible members and slots are one of: (i) circumferentially distributed, and (ii) laterally distributed.

13. The downhole tool of claim 10, wherein the plurality of frangible members and slots are axially distributed.

14. The downhole tool of claim 10, wherein the plurality of frangible members and slots are arranged to form axially distributed columns and at least one of: (i) laterally distributed slots, and (ii) circumferentially distributed slots.

15. The downhole tool of claim 10, wherein at least one of the first tool part and the second tool part is tubular.

16. The downhole tool of claim 10, wherein at least one of the first tool part and the second tool part is non-tubular.

17. The downhole tool of claim 10, wherein a first set of the plurality of frangible members resist a loading applied in a first direction and a second set of the plurality of frangible members resist a loading in a second direction that is different from the first direction, and wherein the second set of frangible members has a different number of frangible members than the first set of frangible members.

18. The apparatus of claim 17, wherein the applied loadings in the first and the second direction are one of: (i) an axially applied loading, and (ii) a torsional loading.

19. A method for temporarily connecting a first tool part to a second tool part of a tool, comprising:

connecting the first tool part to the second tool part by using a plurality of frangible members, the frangible members being configured to break only after being subjected to a predetermined applied force, the frangible members cooperating to differentially resist loading applied to the tool, wherein the frangible members are fixed in the first tool part and further comprising a body associated with the second tool part, wherein the body includes a plurality of slots formed thereon, wherein at least one frangible member of the plurality of frangible members is received in one slot of the plurality of slots.

20. The method of claim 19, wherein the loading comprises a first load in a first direction and a second load in a second direction different from the first direction, and further comprising:

resisting the first load by using the plurality of frangible members to cooperatively resist the first load at the same time; and sequentially breaking the frangible members by applying the second load.

21. The method of claim 19, further comprising:

conveying the first tool part and the second tool part, while connected, along a borehole while using the plurality of frangible members to resist an applied loading resulting from a loading selected from at least one of: (i) an axial loading, and (ii) a torsional loading; and releasing the first tool part from the second tool part by applying the predetermined applied force to the plurality of frangible members, the predetermined force being applied from a direction that is different from a direction of the applied loading.

* * * * *